US011322341B2

(12) United States Patent
Murata

(10) Patent No.: US 11,322,341 B2
(45) Date of Patent: May 3, 2022

(54) PROBE ELECTROSPRAY IONIZATION MASS SPECTROMETRY

(71) Applicant: SHIMADZU CORPORATION, Kyoto (JP)

(72) Inventor: Tasuku Murata, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/058,918

(22) PCT Filed: May 31, 2018

(86) PCT No.: PCT/JP2018/021061

§ 371 (c)(1),
(2) Date: Mar. 15, 2021

(87) PCT Pub. No.: WO2019/229963

PCT Pub. Date: Dec. 5, 2019

(65) Prior Publication Data

US 2021/0217603 A1 Jul. 15, 2021

(51) Int. Cl.

| | |
|---|---|
| ***H01J 49/16*** | (2006.01) |
| ***H01J 49/00*** | (2006.01) |
| ***H01J 49/02*** | (2006.01) |
| ***H01J 49/04*** | (2006.01) |

(52) U.S. Cl.
CPC ..... *H01J 49/165* (2013.01); *H01J 49/0031* (2013.01); *H01J 49/0036* (2013.01);
(Continued)

(58) Field of Classification Search
CPC .. H01J 49/165; H01J 49/0031; H01J 49/0036; H01J 49/022; H01J 49/025;
(Continued)

(56) References Cited

U.S. PATENT DOCUMENTS

2009/0140137 A1* 6/2009 Hiraoka ..... G01N 30/7266 250/282
2017/0236699 A1 8/2017 Ueda et al.
(Continued)

FOREIGN PATENT DOCUMENTS

EP 2 017610 A1 1/2009
EP 3 196 640 A1 7/2017
(Continued)

OTHER PUBLICATIONS

Yumi Hayashi et al., "Development of an in Vivo Real-Time Monitoring Technique by PESI/MS/MS", Shimadzu Review, Sep. 20, 2017, 15 pgs., vol. 74, Nos. 1-2 2.
(Continued)

*Primary Examiner* — Kiet T Nguyen
(74) *Attorney, Agent, or Firm* — Sughrue Mion, PLLC

(57) ABSTRACT

The probe drive unit (21) collects a sample (8) at the tip of the probe (6) by lowering and raising the probe (6) under the control of the control unit (25). After that, the high voltage generating unit (20) applies a high voltage whose voltage value increases in a slope shape to the probe (6), and meanwhile, the mass spectrometry unit behind the capillary tube (10) performs product ion scan measurements on the two-step probe voltage, and the mass spectrum data obtained in each measurement is stored in the first and the second probe voltage corresponding data storage units (301 and 302). When the ionization efficiencies of the plurality of types of components contained in the sample (8) have a probe voltage dependence, ion peaks derived from different types of components appear in the two mass spectra. Thus, a plurality of types of components contained in the sample can be roughly separated, and the identification performance based on the mass spectrum and the quantitative performance based on the chromatogram can be improved.

5 Claims, 4 Drawing Sheets

(52) U.S. Cl.
CPC ..... *H01J 49/022* (2013.01); *H01J 49/025* (2013.01); *H01J 49/0409* (2013.01); *H01J 49/0445* (2013.01); *H01J 49/0459* (2013.01)

(58) Field of Classification Search
CPC .. H01J 49/168; H01J 49/0409; H01J 49/0445; H01J 49/0459
USPC ..... 250/288
See application file for complete search history.

(56) References Cited

U.S. PATENT DOCUMENTS

| | | | | |
|---|---|---|---|---|
| 2019/0079050 | A1 | 3/2019 | Zaitsu et al. | |
| 2021/0175064 | A1* | 6/2021 | Murata | G01N 27/62 |

FOREIGN PATENT DOCUMENTS

| | | | |
|---|---|---|---|
| JP | 2014-044110 | A | 3/2014 |
| WO | 2016/027319 | A1 | 2/2016 |
| WO | 2017/154240 | A1 | 9/2017 |

OTHER PUBLICATIONS

International Search Report for PCT/JP2018021061 dated Aug. 7, 2018 (PCT/ISA/237).
Written Opinion of the International Search Report for PCT/JP2018/021061 dated Aug. 7, 2018 (PCT/ISA/237).
Extended European Search Report dated Jun. 7, 2021 in European Application No. 18921234.3.

* cited by examiner

PROBE ELECTROSPRAY IONIZATION MASS SPECTROMETRY

TECHNICAL FIELD

The present invention relates to a mass spectrometer equipped with an ion source utilizing the probe electrospray ionization (PESI) method.

BACKGROUND ART

As the ionization method for ionizing a component in a sample to be measured in a mass spectrometer, various method have been conventionally proposed and put to practical use. As a method for ionizing under the atmospheric pressure, the electrospray ionization (ESI) method is well known, and in recent years the PESI method has attracted attention among the ionization methods using the ESI.

As disclosed in Patent Literatures 1, 2 and the like, the PESI ion source includes: a conductive probe with a tip diameter of several hundred nanometers; a displacement unit which moves at least one of the probe and a sample so that the sample is attached to the tip of the probe; and a high voltage generating unit which applies a high voltage to the probe while the sample is attached at the tip of the probe. At the time of measurement, at least one of the probe and the sample is moved by the displacement unit, the tip of the probe is brought into contact with or slightly inserted into the sample, and a small amount of sample is attached to the tip surface of the probe. After that, the probe is separated from the sample by the displacement unit, and a high voltage is applied to the probe from the high voltage generating unit. Then, a strong electric field acts on the sample attached to the tip of the probe, an electrospray phenomenon is caused, and the molecules of components in the sample are ionized and desorbed.

In a mass spectrometer using a PESI ion source (which, hereinafter, may be referred to as "PESI mass spectrometer"), time-consuming sample pretreatment is unnecessary and liquid sample can be used for analysis almost as it is, so that simple and quick analysis is possible. In addition, as disclosed in Non-Patent Literature 1, real-time observation of the amount of a specific component in a biological tissue such as a living laboratory animal is also possible.

However, since such analysis does not separate components by liquid chromatography (LC) or the like, in the mass spectrum obtained by the analysis, ion peaks derived from a plurality of components contained in the sample appear in a mixed manner. In this way, if peaks derived from a plurality of components are mixed on a mass spectrum, or if peaks derived from other components appear in addition to peaks derived from the target component, it is difficult to identify the target component by pattern matching, database search, or the like.

One method for improving component identification performance is to improve ion selectivity by performing MS/MS analysis, as is also performed in Non-Patent Literature 1. However, since a sample derived from a living body, for example, generally contains many kinds of components, and often contains a plurality of kinds of components having similar chemical structures, it is often the case that the mass-to-charge ratio of precursor ions of the target component and the mass-to-charge ratio of precursor ions derived from other components are the same or very close. In such a case, it is difficult to distinguish between the peak derived from the target component and the peak derived from other component even in the mass spectrum (product ion spectrum) obtained by MS/MS analysis, which sometimes lowers the identification accuracy and quantification accuracy of the target component.

CITATION LIST

Patent Literature

Patent Literature 1: JP 2014-44110 A
Patent Literature 2: WO 2016/027319 A1

Non Patent Literature

Non Patent Literature 1: Yumi Hayashi and 5 others, "Development of an in Vivo Real-Time Monitoring Technique by PESI/MS/MS", *Shimadzu Review*, Vol. 74, Nos. 1 and 2, Sep. 20, 2017.

SUMMARY OF INVENTION

Technical Problem

The present invention has been made to solve the above problems, and an object of the present invention is to provide a PESI mass spectrometer in which a plurality of components contained in the sample are separated to some extent, so that the qualitative performance (identification accuracy) and quantitative performance of the target component for example, are improved.

Solution to Problem

The present invention made to solve the above problems is a probe electrospray ionization mass spectrometer including: an ion source including a probe being conductive, a high voltage generating unit configured to apply a probe voltage being a high voltage to the probe, and a displacement unit configured to move at least one of the probe and a sample so that the sample is attached to a tip of the probe, the ion source configured to cause the displacement unit to attach apart of the sample to the tip of the probe and to apply the probe voltage to the probe with the tip of the probe separated from the sample to ionize a component in the sample attached to the probe under atmospheric pressure; and a mass spectrometry unit configured to perform mass spectrometry on ions generated by the ion source, the probe electrospray ionization mass spectrometer including:

a) a probe voltage control unit configured to control the high voltage generating unit so that the high voltage generating unit changes a probe voltage applied to the probe to a plurality of voltage values;

b) an analysis control unit configured to control the mass spectrometry unit so that the mass spectrometry unit performs mass spectrometry on the same sample with probe voltages different from each other applied to the probe under a control of the probe voltage control unit to acquire respective mass spectrometry results; and c) an analysis processing unit configured to identify a component in the sample or quantify a target component in the sample based on at least one of the plurality of mass spectrometry results obtained under different probe voltages under a control of the analysis control unit.

In the present invention, the mass spectrometry unit has only to be a mass spectrometer capable of taking in ions generated under substantially atmospheric pressure and performing mass spectrometry. It may be, for example, a single type quadrupole mass spectrometer, a triple quadrupole mass spectrometer capable of MS/MS analysis, a quadrupole-time-of-flight (Q-TOF) mass spectrometer in combination of a quadrupole mass filter and a time-of-flight mass separator, or the like.

In the first aspect of the present invention, the probe voltage control unit causes the displacement unit to move one or both of the probe and the sample to attach a sample at a tip of the probe, and then changes the probe voltage, which is applied by the high voltage generating unit to the probe, to a plurality of voltage values. The change in the voltage value in this case may be substantially continuous (slope-shaped) or step-shaped. Then, the mass spectrometry unit performs mass spectrometry on a same sample at different probe voltages under a control of the analysis control unit, and acquires respective mass spectrometry results such as mass spectra. That is, in this case, a plurality of mass spectrometric results at different probe voltages are obtained for one sampling.

On the other hand, in the second aspect of the present invention, the probe voltage control unit causes the displacement unit to move one or both of the probe and the sample to attach the sample to the tip of the probe repeatedly, and changes a voltage value of the probe voltage, which is applied to the probe by the high voltage generating unit, each time the sample is attached. Then, the mass spectrometry unit performs mass spectrometry on a same sample each time the sample is attached under the control of the analysis control unit, and acquires a mass spectrometry result. That is, in this case, one mass spectrometry result is obtained for one sampling, and a plurality of mass spectrometry results at different probe voltages are obtained by repeating the sampling a plurality of times. In any one of the first aspect and the second aspect, a plurality of mass spectrometry results at different probe voltages for the same sample are obtained.

The ionization efficiency of various components (compounds) in the PESI ion source depends not a little on the probe voltage due to the difference in the physical and chemical properties of the components. Therefore, for example, it sometimes occurs that a component A is ionized much when a probe voltage at a relatively low voltage value is applied to the probe, while another component B is hardly ionized at that voltage value, and is ionized at a voltage value considerably higher than that. In that case, if the sample contains both the component A and the component B, the probe voltage is changed between the voltage value suitable for ionization of the component A and that suitable for ionization of the component B, or the probe voltage is changed in the range of the voltage value including the voltage values of the two. When a mass spectrometry is performed applying the high voltage to the probe with each of the two voltage values, it is possible to obtain the mass spectrometry result for the component A contained in the sample and the mass spectrometry result for the component B contained in the sample. That is, it is possible to obtain mass spectra in which the peaks are separated to some extent for each component, rather than a mass spectrum in which the peaks derived from the component A and the peaks derived from the component B coexist.

Then, the analysis processing unit identifies one or more components in the sample or quantifies one or ore target components based on at least one of a plurality of mass spectrometry results for different probe voltages. For example, when the component A is the target component and the component B is a mere indifferent component, it is sufficient to identify the target component based on only one mass spectrometry result for the component A among a plurality of mass spectrometry results. When both the component A and the component B are the target components, both the components A and B can be identified based on the mass spectrometry results of the component A and the mass spectrometry results of the component B, respectively.

However, it can occur that a plurality of components cannot be completely separated by the voltage value of the probe voltage, and for example, one mass spectrometry result is a mixture of the component A and the component B, and another mass spectrometry result is derived only from the component B. In that case, by subtracting the latter mass spectrometry result from the former mass spectrometry result, the mass spectrometry result in which the influence of the component B is excluded or reduced can be obtained, and the component A can be identified from the mass spectrometry result. Thus, it is sometimes possible to use the plurality of mass spectrometry results together.

The mass spectrometry result may be not only a mass spectrum but also a mass chromatogram (extracted ion chromatogram) or a total ion chromatogram. For example, as disclosed in Non-Patent Literature 1 described above, when it is desired to observe a temporal change in the amount (or concentration) of a specific component in a biological sample, the area value of the peak in the mass chromatogram or the total ion chromatogram is obtained, and the quantitative value is calculated based on the area value. Also in this case, a mass chromatogram or a total ion chromatogram in which the influence of other components is excluded or reduced can be created, and the quantification accuracy can be improved.

In the case that, as described above, the voltage value of the probe voltage is changed in a slope shape, while mass spectrometry is performed twice or more, it is possible for the probe voltage control unit to control the high voltage generating unit so that the inclination of the slope-shaped voltage change is set at a plurality of values.

The change in the value of inclination of the slope-shaped voltage change means that the amount of voltage change per unit time changes. Thus, the amount of ions derived from the same component and the type of the component observed in a mass spectrometry can adjusted, so that the sensitivity and resolution of ions in, for example, the mass spectrum can be adjusted according to the purpose.

Advantageous Effects of Invention

According to the PESI mass spectrometer according to the present invention, it is possible to obtain a mass spectrometry result in which a plurality of types of components contained in a sample are separated to some extent without performing component separation such as a chromatograph. Thus, it is possible to separate, for example, the target component and other component contained in the sample, so that the identification accuracy and the quantification accuracy of the target component are improved.

DESCRIPTION OF EMBODIMENTS

Figure 1:
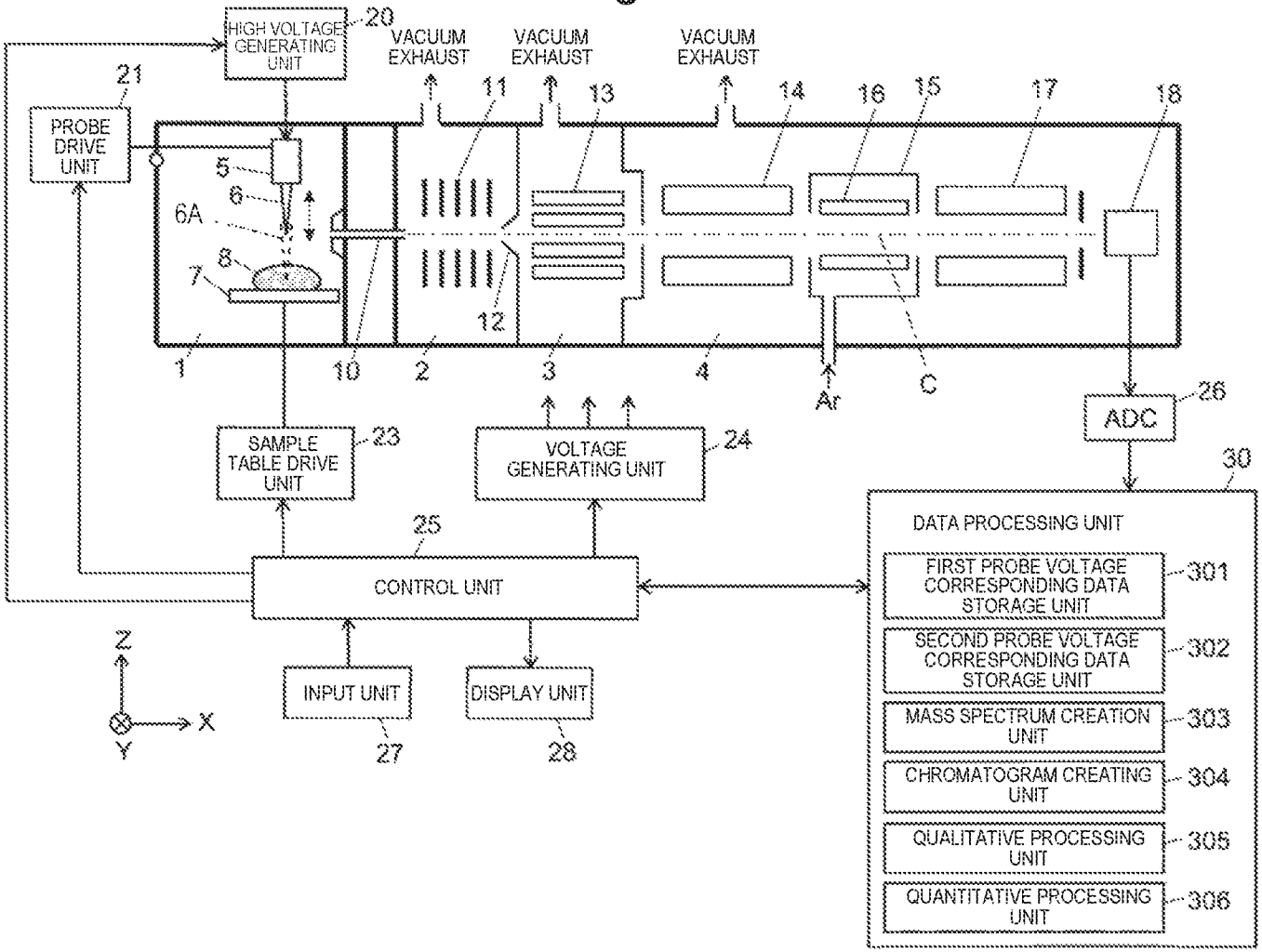
FIG. 1 is a schematic block diagram of one embodiment of a PESI mass spectrometer according to the present invention.

First, an example of the PESI mass spectrometer according, to the present invention will be described. FIG. 1 is a schematic block diagram of the PESI mass spectrometer of the present embodiment.

As shown in FIG. 1, the PESI mass spectrometer has a configuration of a multistage differential exhaust system including a plurality of (two in this example) intermediate vacuum chambers 2, 3 whose degree of vacuum is increased in stages between the ionization chamber 1 in which the components contained in the sample are ionized under the atmospheric pressure and the analysis chamber 4 in which the mass separation and detection of ions are performed in a high vacuum.

The sample 8 to be measured is placed on the sample table 7 arranged in the ionization chamber 1 which has a substantially atmospheric pressure. Above the sample 8, a metallic probe 6 held by the probe holder 5 is arranged so as to extend in the vertical direction (Z-axis direction). The probe holder 5 is movable in the vertical direction (Z-axis direction) by a probe drive unit 21 including a motor and a speed reduction mechanism. In addition, the sample table 7 is movable in the biaxial directions of the X-axis and the Y-axis by the sample table drive unit 23. In addition, a high voltage of about several kV at the maximum is applied to the probe 6 from the high voltage generating unit 20.

The inside of the ionization chamber 1 and the inside of the first intermediate vacuum chamber 2 are communicated with each other through a capillary tube 10 with a small diameter, and the pressure difference between the openings at both ends of the capillary tube 10 draws the gas in the ionization chamber 1 into the first intermediate vacuum chamber 2 through the capillary tube 10. Inside the first intermediate vacuum chamber 2, an ion guide 11 including a plurality of electrode plates arranged along the ion optical axis C and around the ion optical axis C is provided. In addition, the inside of the first intermediate vacuum chamber 2 and the inside of the second intermediate vacuum chamber 3 communicate with each other through a small hole formed at the top portion of the skimmer 12. In the second intermediate vacuum chamber 3, an octapole type ion guide 13 in which eight rod electrodes are arranged around the ion optical axis C is installed. Furthermore, in the analysis chamber 4, a front-stage quadrupole mass filter 14 in which four rod electrodes are arranged around the ion optical axis C, a collision cell 15 in which an ion guide 16 is arranged inside, a back-stage quadrupole mass filter 17 having the same electrode structure as the front-stage quadrupole mass filter 14, and an ion detector 18 are installed.

A collision gas such as argon or helium is continuously or intermittently introduced into the collision cell 15 from the outside. In addition, from the voltage generating unit 24, any one of the DC voltage, the radio-frequency voltage, and a voltage obtained by superimposing the radio-frequency voltage on the DC voltage is applied to the respective ion guides 11, 13, and 16, the quadrupole mass filters 14 and 17, the ion detector 18, and the like.

The detection signal by the ion detector 18 is digitized by the analog-to-digital converter (ADC) 26 and input into the data processing unit 30. As a functional block, the data processing unit 30 includes a first probe voltage corresponding data storage unit 301, a second probe voltage corresponding data storage unit 302, a mass spectrum creation unit 303, a chromatogram creation unit 304, a qualitative processing unit 305, and a quantitative processing unit 306. In addition, the control unit 25 performs analysis on the sample 8 by controlling each of the high voltage generating unit 20, the probe drive unit 21, the sample table drive unit 23, the voltage generating unit 24, and the like. In addition, an input unit 27 and a display unit 28 as a user interface are connected to the control unit 25.

The mass spectrometry operation in the PESI mass spectrometer of the present embodiment will be schematically described.

The sample 8 is assumed to be a biological sample such as a biological tissue section, for example. When the probe drive unit 21 moves the probe 6 down to a predetermined position (the position indicated by the dotted line 6A in FIG. 1) in response to an instruction from the control unit 25, the tip of the probe 6 pierces the sample 8, and a minute amount of sample attached to the tip of the probe 6. Then, when the probe 6 is pulled up to a predetermined analysis position (the position indicated by the solid line 6 in FIG. 1), the high voltage generating unit 21) applies a high voltage to the probe 6. Thus, the electric field is concentrated on the tip of the probe 6, and the components in the sample attached to the tip of the probe 6 are ionized by the electrospray phenomenon.

The generated ions are sucked into the capillary tube 10 due to the pressure difference, and are sequentially transported to the first intermediate vacuum chamber 2, the second intermediate vacuum chamber 3, and the analysis chamber 4 by the action of the respective electric fields formed by the ion guides 11 and 13. In the analysis chamber 4, the ions are introduced into the front-stage quadrupole mass filter 14, and only the ions (precursor ions) having a mass-to-charge ratio corresponding to the voltage applied to the rod electrode of the quadrupole mass filter 14 pass through the quadrupole mass filter 14 and are introduced into the collision cell 15. A collision gas is introduced in the collision cell 15, and in the collision cell 15, the ions collide with the collision gas and cleave by collision-induced dissociation (CID). Various types of product ions generated by cleavage exit the collision cell 15 to be introduced into the back-stage quadrupole mass filter 17, and only the product ions having a mass-to-charge ratio corresponding to the voltage applied to the rod electrode of the quadrupole mass filter 17 pass through the back-stage quadrupole mass filter 17 and reach the ion detector 18. The ion detector 18 generates a detection signal corresponding to the amount of ions reached.

For example, setting the voltage applied to the rod electrode of the quadrupole mass filter 14 so that only the ions having a specific mass-to-charge ratio pass through the front-stage quadrupole mass filter 14, and at the same time, scanning the voltage applied to the rod electrode of the quadrupole mass filler 17 so that the mass-to-charge ratio of the ions passing through the back-stage quadrupole mass filter 17 changes sequentially within a predetermined range, make it possible to acquire a detection signal for creating a product ion spectrum in a predetermined mass-to-charge ratio range with respect to specific precursor ions.

Figure 2:
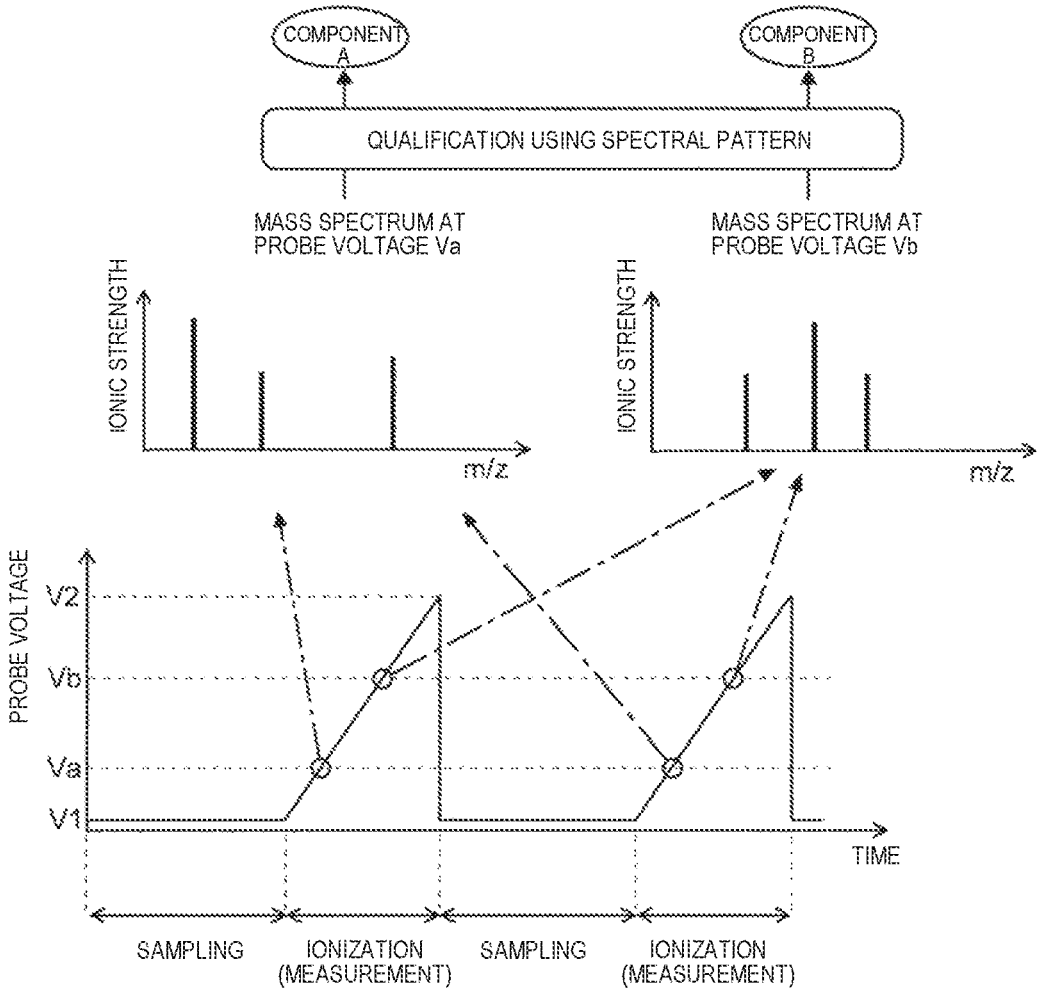
FIG. 2 is an explanatory diagram of the temporal change of the probe voltage and the processing operation at that time when a plurality of components in a sample are identified in the PESI mass spectrometer of the present embodiment.
Figure 3:
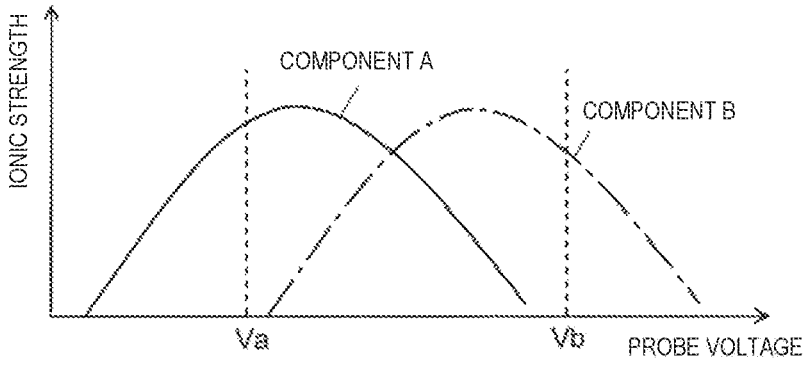
FIG. 3 is a schematic diagram of an example of the relationship between the probe voltage and the ionic strength in the PESI ion source.

Next, the characteristic analysis operation in the PESI mass spectrometer of the present embodiment will be described with reference to FIGS. 2 and 3. FIG. 2 is an explanatory diagram of the temporal change in the probe voltage when identifying a plurality of components in the sample and the processing operation at that time, and FIG. 3 is a schematic diagram of an example of the relationship between the probe voltage and the ionic strength.

As described above, the probe drive unit 21 lowers the lower end of the probe 6 to a predetermined height and then raises it to the analysis position in response to the instruction of the control unit 25. The height at the time of descending is adjusted in advance so that the lower end of the probe 6 is inserted into the predetermined depth of the sample 8. Thus, a minute amount of sample attached to the tip of the probe 6, and the probe 6 is set at a predetermined analysis position in that state. The descending and ascending motions of the probe 6 are performed during the period indicated by "sampling" in FIG. 2.

When the probe 6 with the sample attached to its tip is set at the analysis position, according to the instruction of the control unit 25, the high voltage generating unit 20 applies a high voltage whose voltage value increases in a slope shape from V1 to V2 as the time lapses to the probe 6 as shown in FIG. 2. It should be noted that in this case, since it is assumed that the polarity of the ions to be measured is positive, a high positive voltage is applied to the probe 6, but when the polarity of the ions to be measured is negative, a high voltage that has a negative polarity and the absolute value of the voltage increases in a slope shape has only to be applied to the probe 6. As described above, when a high voltage having a voltage value not less than a certain degree is applied to the probe 6, the components in the sample attached to the tip of the probe 6 are ionized by the electrospray phenomenon.

However, in general, the relationship between the voltage applied to the probe 6 and the ionization efficiency differs depending on the component, that is, the physical properties and chemical properties (polarity, easiness of volatilization, and the like) of the components contained in the sample. In this case, for simplicity of description, it is assumed that there are contained in the sample two types of components A and B in which the relationship between the probe voltage and the ionic strength (that is, the ionization efficiency) is as shown in FIG. 3. The component B has a high ionic strength at an overall higher probe voltage than the component A. Now, Va is selected as the probe voltage at which ions derived from the component A are detected with sufficiently high strength while ions derived from the component B are hardly detected. In addition, conversely, Vb is selected as the probe voltage at which ions derived from the component B are detected with sufficiently high strength while ions derived from the component A are hardly detected.

Then, while the voltage applied to the probe 6 changes from V1 to V2 ("ionization (measurement)" period in FIG. 2), the control unit 25 controls the voltage generating unit 24 and the data processing unit 30 so that the mass spectrum corresponding to the component A is acquired at the timing when the probe voltage is close to Va, and successively the mass spectrum corresponding to the component B is acquired at the timing when the probe voltage is close to Yb. Specifically, the product ion scan measurements for one or more preset precursor ions are performed respectively at the time point when the probe voltage is close to Va and at the time point when the probe voltage is close to Vb. Thus, as shown in FIG. 2, the data constituting the mass spectrum at each time point can be obtained. In the data processing unit 30, the first probe voltage corresponding data storage unit 301 temporarily stores the mass spectrum data acquired when the probe voltage is near Va. On the other hand, the second probe voltage corresponding data storage unit 302 temporarily stores the mass spectrum data acquired when the probe voltage is near Vb. In this way, while the probe voltage changes from V1 to V2, two pieces of mass spectrum data for different probe voltages Va and Vb can be obtained.

It should be noted that actually, since the probe voltage changes even during one product ion scan measurement, strictly speaking, they are not mass spectrum data for the probe voltages Va and Vb, but mass spectrum data for the probe voltages to reach Va and Vb either at the start, end, or during execution of the product ion scan measurement has only to be regarded as mass spectrum data for the probe voltages Va and Vb.

As described above, at the probe voltage Va, ions derived from the component A are detected, and ions derived from the component B are hardly detected. On the other hand, at the probe voltage Vb, ions derived from the component B are detected, and ions derived from the component A are hardly detected. Therefore, the mass spectrum data stored in the first probe voltage corresponding, data storage unit 301 is the mass spectrum data substantially corresponding to the component A, and the mass spectrum data stored in the second probe voltage corresponding data storage unit 302 is the mass spectrum data substantially corresponding to the component B. Now, for example, when it is desired to identify both components A and B (or to check whether the components A and B exist), the mass spectrum creation unit 303 creates a mass spectrum based on the respective mass spectrum data stored in the data storage units 301 and 302. Then, the qualitative processing unit 305 identifies the respective components by the library search based on the created two mass spectra.

As is well known, the library search uses a library including standard mass spectra acquired for various components (compounds), and evaluating the conformity of the spectral patterns between the mass spectrum in the library and the mass spectrum actually measured allows component to be identified. Naturally, the method for qualitative processing is not limited to this, and for example, in component identification targeting proteins and peptides, it is preferable to use a database search method using a protein sequence database.

It should be noted that for example, when one of the components A and B is the target component and the other is a mere indifferent component and there is no need to identify the indifferent component, only the mass spectrum corresponding to the target component has to be created and the identification processing has only to be executed.

Figure 4:
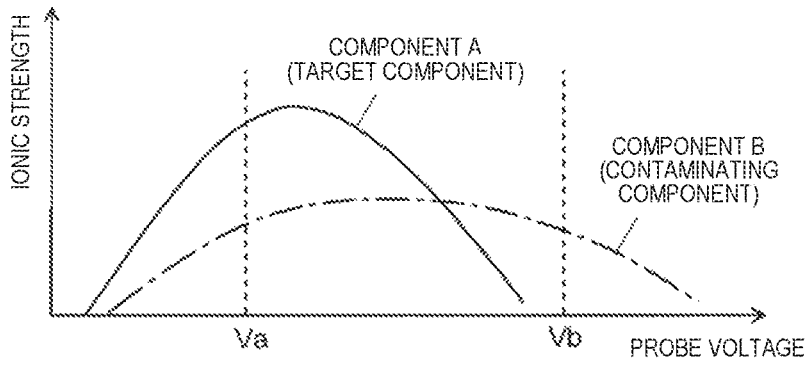
FIG. 4 is a schematic diagram of another example of the relationship between the probe voltage and the ionic strength in the PESI ion source.

In addition, in the above description, as shown in FIG. 3, it is assumed that a plurality of components can be separated almost completely by the probe voltage, but in some cases, as shown in FIG. 4, it is also conceivable that it is difficult to completely separate a plurality of components by the probe voltage because the component B is ionized over a wide range of probe voltage. In the example shown in FIG.

4, ions derived from the component B being an indifferent component are detected at the probe voltage Vb, and ions derived from the component A being a target component are hardly detected. However, at the probe voltage Va, both the ions derived from the component A and the ions derived from the component B are detected. In this case, since the ion peak derived from the component A and the ion peak derived from the component B are mixed in the mass spectrum for the probe voltage Va it is difficult to perform the component identification by a library search or the like as it is.

Therefore, in this case, the mass spectrum creation unit 303 appropriately adjusts the intensity of the peak in the mass spectrum for the probe voltage Vb, and then performs processing of subtracting the mass spectrum for the probe voltage Vb after the peak intensity adjustment from the mass spectrum for the probe voltage Va. Thus, each ion peak derived from the component B is removed from the mass spectrum for the probe voltage Va, or the peak intensity is greatly reduced even if it is not removed. Then, when a mass spectrum in which the ion peak derived from the component A is mainly observed is obtained, providing the mass spectrum to the identification processing performs component identification.

In addition, not in the identification processing (qualitative processing) based on the mass spectrum, but also in the quantitative processing based on the chromatogram, as described above, it is possible to create a chromatogram in which a plurality of components are separated by the probe voltage and to perform quantification. Now, for example, it is assumed that each of the component A and the component B shown in FIG. 3 is quantified. In this case, since the components A and B are known (or the components to be quantified are determined), product ion scan measurement may be performed, or multiple reaction monitoring (MRM) measurement may be performed.

That is, the cycle of sampling and ionization (measurement) as shown in FIG. 2 is repeated for a predetermined time, and in each cycle, each of the ionic strength in the MRM measurement targeting the component A at the probe voltage Va and the ionic strength in the MRM measurement targeting the component B at the probe voltage Vb is obtained. Then, the chromatogram creation unit 304 creates a mass chromatogram for the component A and a chromatogram for the component B from the ionic strength data. Even if the transitions of MRM measurement are the same between the component A and the component B, these two respective mass chromatograms reflect the strength of the ions derived from the component A and the strength of the ions derived from the component B. Thus, the quantitative processing unit 306 obtains the respective area values of the peaks observed in the two mass chromatograms, and calculates the respective amounts (concentrations) of the components A and B based on the area values.

In this way, the accuracy of quantification of the target component can be improved, or a plurality of components contained in the sample care be separated and quantified with high accuracy.

Figure 5:
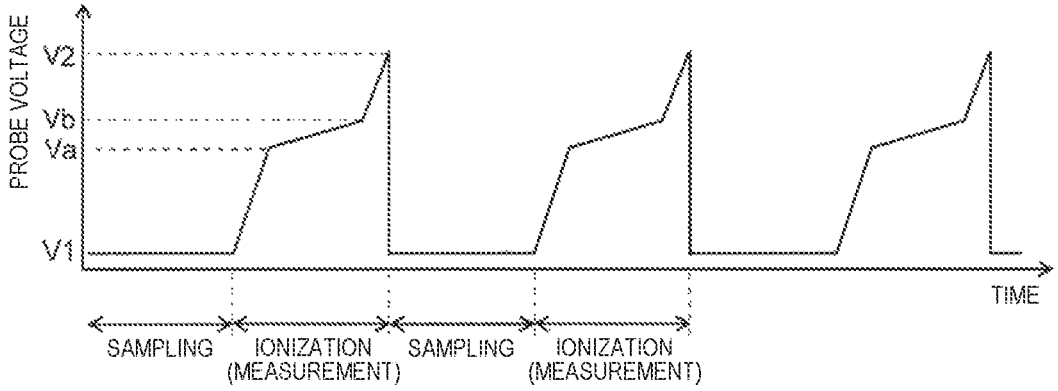
FIG. 5 is a diagram showing another example of the temporal change of the probe voltage in the PESI mass spectrometer of the present embodiment.
Figure 6A:
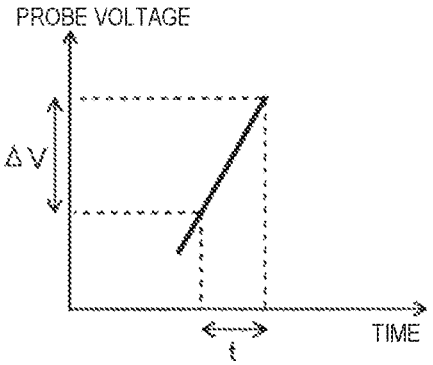
FIGS. 6A-6B are diagrams showing the probe voltage change amount per unit time.
Figure 6B:
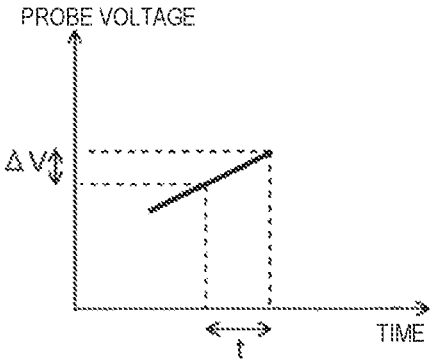

In the above embodiment, the scanning speed (that is, the inclination of the voltage change slope) when changing the probe voltage from V1 to V2 (that is, scanning the probe voltage) is constant, but the scanning speed may be changed into a plurality of steps. FIG. 5 is a diagram showing another example of the temporal change of the probe voltage. In this example, the scanning speed of the probe voltage from voltage Va to Vb is lower than the scanning speed of the probe voltage from voltage V1 to Va. FIGS. 6A and 6B are diagrams showing the voltage change amount per unit time t when the scanning speed is high and low.

Since the time required to perform one product ion scan measurement is almost the same for the probe voltages Va and Vb, the range of the probe voltage reflected in one product ion scan measurement when the scanning speed is low is narrower than the range when the scanning speed is high. Therefore, in general, reducing the scanning speed improves the separation accuracy of the components. In addition, reducing the scanning speed allows the amount of ions generated in the narrow voltage range to be increased, so that the detection sensitivity is improved. On the other hand, reducing the scanning speed increases the time required for one cycle, so that the accuracy of grasping the amount of the component whose amount temporally changes decreases. Thus, the scanning speed of the probe voltage causes differences in separation performance, detection sensitivity, quantitativeness, and the like, so that it is advisable to appropriately determine the scanning speed of the probe voltage according to the purpose.

Figure 7:
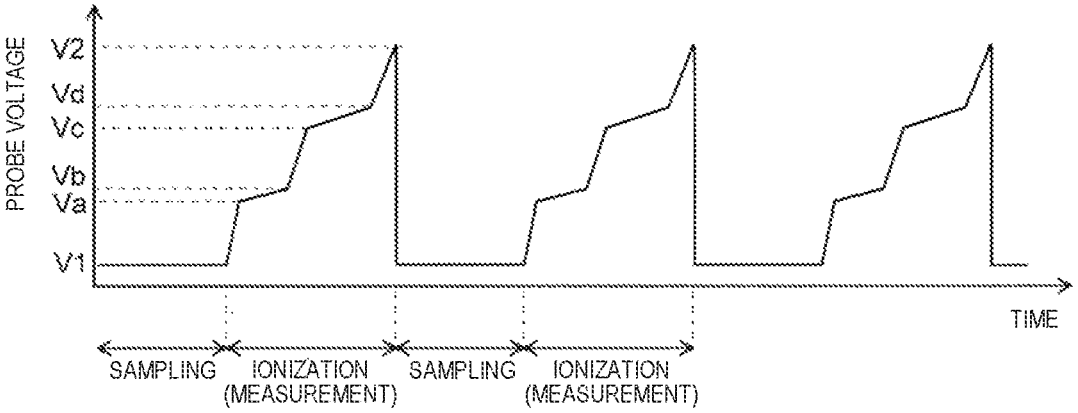
FIG. 7 is a diagram showing another example of the temporal change of the probe voltage in the PESI mass spectrometer of the present embodiment.

In addition, FIG. 7 shows an example of the temporal change of the probe voltage when it is desired to separate the four types of components contained in the sample. In this example, the scanning speed of the probe voltage is increased in the range of the voltages V1 to Va and Vb to Vc, and the scanning speed of the probe voltages is reduced in the range of the voltages Va to Vb and Vc to Vd. Thus, appropriately determining the scanning speed of the probe voltage according to the voltage range allows the time required for one cycle to be kept as short as possible while improving the detection sensitivity and separation performance in a desired voltage range.

Figure 8:
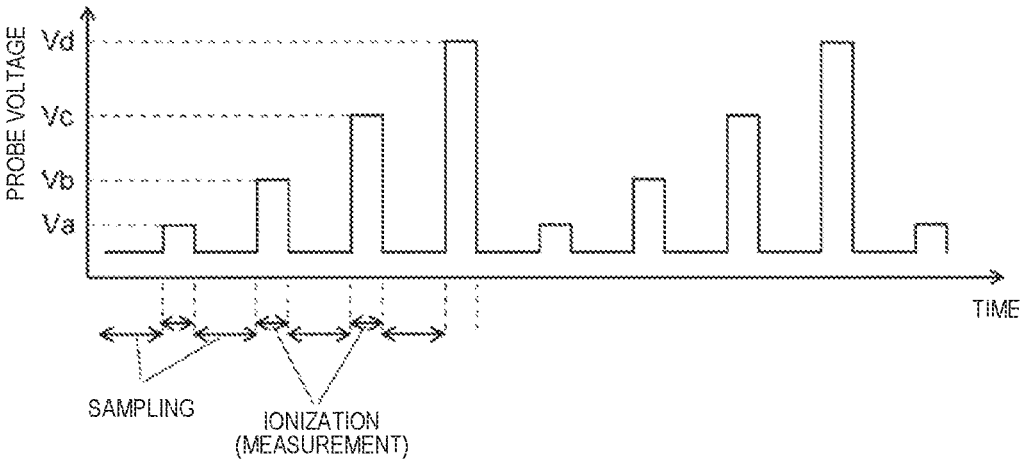
FIG. 8 is a diagram showing still another example of the temporal change of the probe voltage in the PESI mass spectrometer of the present embodiment.

In addition, in the above embodiment, the measurement at a plurality of steps of the probe voltages is performed for one sampling, but only the measurement at one step (voltage value) of the probe voltage may be performed for one sampling and the probe voltage may be changed for each sampling. FIG. 8 is a diagram showing an example of a temporal change in the probe voltage when such control is performed. Doing so makes it possible to acquire a mass spectrum or a mass chromatogram for a plurality of steps of probe voltages while shortening the time required for one cycle.

In addition, the above-described embodiment and modifications are all examples of the present invention, and even if appropriate modifications, amendments and additions are made within the scope of the present invention, it is obvious that they are included in the claims of the present application.

For example, the PESI mass spectrometer of the above embodiment uses a triple quadrupole mass spectrometer as the mass spectrometry unit, but a single type quadrupole mass spectrometer that does not perform MS/MS analysis may be used. In this case, instead of the product ion scan measurement, a normal scan measurement has only to be performed to acquire the mass spectrum. In addition, when it is desired to perform quantitative analysis, selective ion monitoring (SIM) measurement instead of MRM measurement has only to perform to create a mass chromatogram. In addition, a Q-TOF type mass spectrometer may be used instead of the triple quadrupole mass spectrometer.

REFERENCE SIGNS LIST

1 . . . Ionization Chamber
2 . . . First Intermediate Vacuum Chamber
3 . . . Second Intermediate Vacuum Chamber

4 . . . Analysis Chamber
5 . . . Probe Holder
6 . . . Probe
7 . . . Sample Table
8 . . . Sample
10 . . . Capillary Tube
11,13,16 . . . Ion Guide
12 . . . Skimmer
14 . . . Front-Stage Quadrupole Mass Filter
15 . . . Collision Cell
17 . . . Back-Stage Quadrupole Mass Filter
18 . . . Ion Detector
20 . . . High Voltage Generating Unit
21 . . . Probe Drive Unit
23 . . . Sample Table Drive Unit
24 . . . Voltage Generating Unit
25 . . . Control Unit
26 . . . Analog-to-Digital Converter (ADC)
27 . . . Input Unit
28 . . . Display Unit
30 . . . Data Processing Unit
301 . . . First Probe Voltage Corresponding Data Storage Unit
302 . . . Second Probe Voltage Corresponding Data Storage Unit
303 . . . Mass Spectrum Creation Unit
304 . . . Chromatogram Creating Unit
305 . . . Qualitative Processing Unit
306 . . . Quantitative Processing Unit
C . . . Optical Axis

The invention claimed is:

1. A probe electrospray ionization mass spectrometer including: an ion source including, a probe being conductive, a high voltage generating unit configured to apply a probe voltage being a high voltage to the probe, and a displacement unit configured to move at least one of the probe and a sample so that the sample is attached to a tip of the probe, the ion source configured to cause the displacement unit to attach a pad of the sample to the tip of the probe and to apply the probe voltage to the probe with the tip of the probe separated from the sample to ionize a component in the sample attached to the probe under atmospheric pressure; and a mass spectrometry unit configured to perform mass spectrometry on ions generated by the ion source, the probe electrospray ionization mass spectrometer comprising:

a) a probe voltage control unit configured to control the high voltage generating unit so that the high voltage generating unit changes a probe voltage applied to the probe to a plurality of voltage values;

b) an analysis control unit configured to control the mass spectrometry unit so that the mass spectrometry unit performs mass spectrometry on the same sample with probe voltages different from each other applied to the probe under a control of the probe voltage control unit to acquire respective mass spectrometry results; and c) an analysis processing unit configured to identify a component in the sample or quantify a target component in the sample based on at least one of the plurality of mass spectrometry results obtained under different probe voltages under a control of the analysis control unit.

2. The probe electrospray ionization mass spectrometer according to claim 1, wherein the probe voltage control unit causes the displacement unit to move one or both of the probe and the sample to attach a sample at the tip of the probe, and then changes the probe voltage, which is applied to the probe from the high voltage generating unit, to a plurality of voltage values, and the mass spectrometry unit performs mass spectrometry on the same sample at different probe voltages under a control of the analysis control unit.

3. The probe electrospray ionization mass spectrometer according to claim 2, wherein the probe voltage control unit controls the high voltage generating unit so that a voltage value of the probe voltage changes in a slope shape.

4. The probe electrospray ionization mass spectrometer according to claim 3, wherein the probe voltage control unit controls the high voltage generating unit so that inclination of a slope-shaped voltage change changes to a plurality of steps.

5. The probe electrospray ionization mass spectrometer according to claim 1, wherein the probe voltage control unit causes the displacement unit to move one or both of the probe and the sample to attach the sample to the tip of the probe repeatedly, and changes a voltage value of the probe voltage, which is applied to the probe from the high voltage generating unit, each time the sample is attached, and the mass spectrometry unit performs mass spectrometry on the same sample each time the sample is attached under a control of the analysis control unit.

* * * * *